United States Patent [19]

Kammerer

[11] Patent Number: 4,681,254

[45] Date of Patent: Jul. 21, 1987

[54] DEVICE FOR THERMOSTATIC VALVES, PARTICULARLY FOR THE TEMPERATURE REDUCTION OF THERMOSTAT - CONTROLLED RADIATORS

[75] Inventor: Gerd Kammerer, St. Georgen, Fed. Rep. of Germany

[73] Assignee: Dieter Grasslin Feinwerktechnik, Fed. Rep. of Germany

[21] Appl. No.: 557,630

[22] Filed: Dec. 2, 1983

[30] Foreign Application Priority Data

Dec. 2, 1982 [DE] Fed. Rep. of Germany ..... 3244603

[51] Int. Cl.[4] ..... F24F 11/00

[52] U.S. Cl. ..... 236/42; 236/46 R

[58] Field of Search ..... 236/46 R, 42, 43; 237/8 R, 70

[56] References Cited

U.S. PATENT DOCUMENTS 1,981,707 11/1934 Newell ..... 236/46 R
4,323,192 4/1982 Jackson ..... 237/8 R

FOREIGN PATENT DOCUMENTS 2550138 12/1977 Fed. Rep. of Germany .... 236/46 R
2727821 1/1979 Fed. Rep. of Germany .
3000388 7/1981 Fed. Rep. of Germany ..... 236/42
3149760 6/1983 Fed. Rep. of Germany .
3148268 6/1983 Fed. Rep. of Germany .

*Primary Examiner*—William E. Wayner
*Attorney, Agent, or Firm*—Hill, Van Santen, Steadman & Simpson

[57] ABSTRACT

For use in a radiator space heating system, a thermostatic valve for controlling the flow of heating agent to the radiator is provided with a bypass and at least two auxiliary valves. One auxiliary valve is disposed in the bypass and controlled by the thermostat. The other auxiliary valve is timer-controlled and disposed in series with the thermostatic valve. When temperature reduction is desired, such as during nighttime operation, the timer-controlled auxiliary valve closes, but the bypass auxiliary valve can open when the set-back temperature is reached.

4 Claims, 3 Drawing Figures

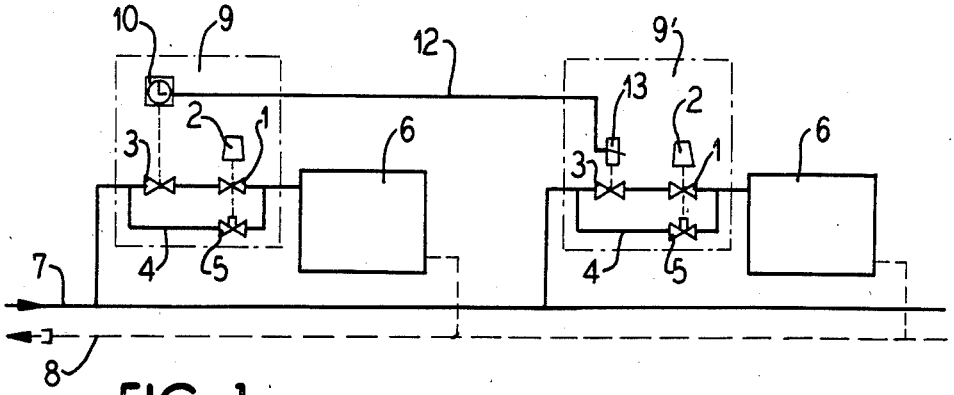
FIG. 1
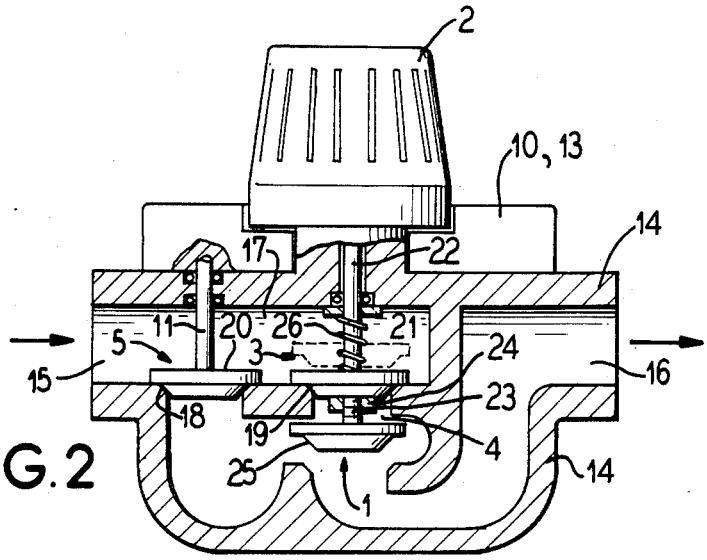
FIG. 2
FIG. 3
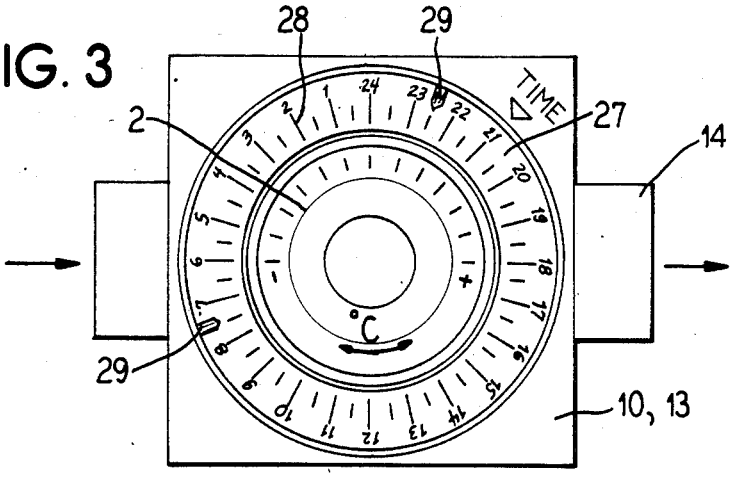

DEVICE FOR THERMOSTATIC VALVES, PARTICULARLY FOR THE TEMPERATURE REDUCTION OF THERMOSTAT - CONTROLLED RADIATORS

BACKGROUND OF THE INVENTION

The invention relates to a device for thermostatic valves that is disposed in the heating agent feed line to a radiator and, more particularly, where such a device is provided with a further, externally controlled valve for the purpose of temperature reduction at the radiator.

In typical space heating systems, it is expedient and desirable to temporarily reduce the room temperature controlled by a thermostatic valve without having to actuate the thermostatic valve. For this purpose, it has been known to equip thermostatic valves with heating resistors that can be switched on by a switch clock and which simulate a higher room temperature to the thermostats of the valves so that said valves allow a smaller quantity of heating agent, i.e. thermal energy, to be passed on through the radiator. However, the operation of a heating resistor control in such a thermostatic valve retrogrades with dropping room temperature given a constant heating resistor power, so it is necessary to increase the power applied to the heating resistor over time via a separate temperature sensor. Thus, this device has the disadvantages of being costly in technical outlay and that the heating system and thermostatic valve operation function with a delay.

Another device for temperature reduction of thermostat-controlled radiators utilizes a second, electro-thermally actuatable valve disposed in the feed line to the radiator, such as disclosed in German Offlegungschrift No. 27 27 821. The switching of this second thermal valve is controlled by means of a switch clock or from heat sensors, whereby the main thermostatic valve is left at its set temperature. This device has the disadvantage that, given a drop in the room temperature, the thermostatic valve can open wider and it is then necessary to oppose an increased flow of heating agent to the radiator with the second thermally controlled valve that acts as a choke.

An object of the present invention is to eliminate these known disadvantages and to create a device for thermostatic valves that enables a low-hysteresis regulation for the heating agent feed to a radiator and is simple in structure.

SUMMARY OF THE INVENTION

In a radiator space heating system, a thermostatic valve controlling heating agent feed to the radiator is provided with a bypass and with at least two auxiliary valves. One auxiliary valve is controlled by the thermostat and is disposed in the bypass. The other is an externally controllable, auxiliary valve disposed in series with the thermostatic valve. Preferably, both the bypass as well as the two auxiliary valves are disposed in a valve box containing the thermostatic valve. The auxiliary valve controlled by the thermostat is in direct mechanical engagement with the valve stem actuating the thermostatic valve. The other auxiliary valve disposed in series with the thermostatic valve is controlled by a time clock or other timer control means and may be activated in mechanical fashion or indirectly in an electro-magnetic or electro-thermal fashion.

As a result of the invention, automatic room temperature control by means of the thermostatic valve can be left in its set position and a temporary lowering of the room temperature in order to achieve a low-hysteresis and fast control is afforded in an expedient manner. Also the simple and easily surveyable structure is afforded by virtue of a shared valve box that is simple to install.

BRIEF DESCRIPTION OF THE DRAWING

FIG. 1 is a schematic view of a space heating system having thermostatic valves for time-controlled temperature reduction of thermostat-controlled radiators, constructed in accordance with the invention.

FIG. 2 is a cross-sectional view of a valve box having a device according to the invention and shows a control means for one auxiliary valve annularly disposed around the thermostatic control.

FIG. 3 is a partial plan view of FIG. 2 showing a time switch clock annularly disposed around the thermostatic control.

DESCRIPTION OF THE PREFERRED EMBODIMENT

FIG. 1 is a schematic illustration of radiator space heating system according to the invention built as a two-pipe split system hot water heating system. The system includes a thermostatic valve 1 controlled by a feed regulator 2 and a first auxiliary valve 3 lying in series with the thermostatic valve 1 which is externally controllable and functions independently of the thermostatic valve 1. A second auxiliary valve 5 is disposed parallel to this series connection of the valves 1 and 3 in a bypass 4 to valves 1 and 3. The second auxiliary valve 5 is coupled to the regulator for the thermostatic valve 1, but its valve cone or valve disk is adjustable relative to the valve cone or valve disk of the thermostatic valve 1, as discussed further below. As those skilled in the art will appreciate, the heating system comprises, in the conventional manner, radiators 6, a heating agent feed line 7 and a heating agent return line 8.

The dot-dash frames 9 and 9' in FIG. 1 indicate the inventive devices, particularly for a time-controlled (by a time switch clock 10) temperature reduction of thermostat-controlled radiators 6 with a relatively low-hysteresis and sufficiently fast regulation of the thermal energy.

The device 9 has the first auxiliary valve 3 coupled to the time switch clock 10. This time switch clock 10 in the device 9 can chronologically control the device 9' via an electrical control line and the appertaining auxiliary valve 3 of device 9' is remotely controlled with an electro-magnetic or electro-thermal means 13. It also lies within the framework of the invention that the auxiliary valve 3 in the device 9' is directly or indirectly controllable in a mechanical, electromagnetic, or electro-thermal fashion.

The second auxiliary valve 5 preferably functions axially with the thermostatic valve 1 such that there is one function direction for the two valves. However, the respective valve cones or valve disks of valves 1 and 5 are adjustable in terms of each valve's own control characteristic. Thus, the valve cone or valve disk of valve 5 is axially adjustable relative to the function direction of the thermostatic valve 1. The amount of temperature reduction relative to the thermostatic valve 1 can be set in degrees Celsius in the simplest case with this adjustment possibility.

During typical daytime operation when a temperature reduction is neither required or desired, the thermostatic valve 1 controls the room temperature. The first, externally controllable auxiliary valve 3 is thereby open. The second auxiliary valve 5 may also be open, for example when the room temperature lies below the daytime temperature by the amount of the nighttime temperature reduction.

During typical nighttime operation, when a temperature reduction is desired and programmed, the first auxiliary valve 3 is kept closed by the timer 10 on the basis of the function of said timer. The second auxiliary valve 5 then opens when the set-back temperature is reached, which set-back temperature is set for this auxiliary valve 5 so that the valve cone or disk is preselectably changed relative to the valve cone or disk of the thermostatic valve 1. The auxiliary valve 5 here functions delayed by the setback temperature relative to the thermostatic valve 1.

FIG. 2 shows a detailed construction of the inventive device 9 or 9'. There is provided a valve box 14 in which all required active and passive piece parts of the device are allocated. Flow of heating agent through the valve box 14 is through the intake opening 15 and discharge opening 16 in the valve box 14. Both openings can be provided with suitable pipe coupling means. Flow through the intake opening 15 discharges into space 17 in which the valve seats 19 for the first auxiliary valve 3 and 18 for the second auxiliary valve 5 are disposed with their respectively appertaining valve cones 21 and 20.

The valve cone 21 of the first auxiliary valve 3 is adjustably seated along the actuating shaft 22 of the thermostatic valve 1. To this end, the actuating shaft 22 can be provided with a thread 23 on which a checking nut 24 in the form of a dog is disposed, the valve cone 21 being axially set therewith relative to the valve cone of the thermostatic valve 1. The valve cone 21 can be axially displaced up to the position indicated with dotted lines. The valve cone 21 is held biased in the direction of an underlying valve cone 25 of the thermostatic valve by means of an axially acting compression spring 26.

The valve cone 20 of the second auxiliary valve 5 is seated on a further actuating shaft 11 operatively connected to the regulator 2 of the thermostat. This enables adjustment of the seating of the valve 5 depending upon the preselection of the valve of the temperature setback relative to the temperature setting of the regular 2 of the thermostat.

The bypass 4 shown in FIG. 1 is between the valve cones 21 and 25 in the present execution of the valve box 14.

The time switch clock 10 and/or some other means serves to operating seating, by direct or indirect control, of the first auxiliary valve 3. The time switch clock 10 and/or an electromagnetic or electro-thermal or some other means is annularly disposed around the head of the regulator 2 of the thermostatic valve 1. The time switch clock 10 and/or other control and regulation means can, if need be, be completely autonomously provided with its own power supply or some other, suitable energy supply and can function maintenance-free over a longer time span.

FIG. 3 shows a portion of the device of FIG. 2. The time switch clock 10 has an adjustable timing disk 27 with dial face 28 and preselectable switch riders 29 annularly disposed around the regulator of the thermostat.

The valve box 14 that can be manufactured of a metal casting or of injection molded synthetic.

Although various minor modifications may be suggested by those versed in the art, it should be understood that I wish to embody within the scope of the patent warranted hereon all such modifications as reasonably and properly come within the scope of my contribution to the art.

I claim as my invention:

1. A thermostatic valve system for controlling the feed of heating agent to a radiator heating means comprising a valve box through which heating agent flows to the radiator, said valve box having a principal flow path defined by a first valve seat opening and a parallel bypass flow path defined by a second valve seat opening, a thermostat control, a first thermostatic valve adjustably seated at said first opening in connection with said thermostat control, a second thermostatic valve adjustably seated at said second opening in connection with said thermostat control, a switch control means, and a further valve adjustably seated at said first opening for opening and closing said first opening in response to said switch control means, wherein said first thermostatic valve and said further valve are respectively disposed on opposed sides of said first opening and are disposed for coaxial movement relative to said first opening.

2. The thermostatic valve system of claim 1, wherein said second thermostatic valve does not open said second opening until a predetermined setback temperature is reached.

3. The thermostatic valve system of claim 1, wherein said switch control means comprises a time switch clock.

4. The thermostatic valve system of claim 3, wherein said time switch clock is connected for simultaneous control of a plurality of further valves in a corresponding plurality of said thermostatic valve systems.

* * * * *